US009885191B2

(12) United States Patent
Winters

(10) Patent No.: US 9,885,191 B2
(45) Date of Patent: Feb. 6, 2018

(54) POOL COVER SUPPORT SYSTEM

(76) Inventor: Russell W. Winters, Manalapan, NJ (US)

( * ) Notice: Subject to any disclaimer, the term of this patent is extended or adjusted under 35 U.S.C. 154(b) by 335 days.

(21) Appl. No.: 13/249,886

(22) Filed: Sep. 30, 2011

(65) Prior Publication Data

US 2012/0137422 A1 Jun. 7, 2012

Related U.S. Application Data

(60) Provisional application No. 61/388,178, filed on Sep. 30, 2010.

(51) Int. Cl.
*E04H 4/00* (2006.01)
*E04H 4/10* (2006.01)

(52) U.S. Cl.
CPC ..... *E04H 4/108* (2013.01); *E04H 4/106* (2013.01)

(58) Field of Classification Search
USPC ..... 4/499, 503, 496
See application file for complete search history.

(56) References Cited

U.S. PATENT DOCUMENTS

| | | | | | |
|---|---|---|---|---|---|
| 2,107,552 | A | * | 2/1938 | Smith | 175/209 |
| 3,461,890 | A | * | 8/1969 | Goodrich | 135/123 |
| 3,769,639 | A | * | 11/1973 | Bishop | 4/498 |
| 4,073,042 | A | * | 2/1978 | Miller | 294/82.19 |
| 4,892,302 | A | * | 1/1990 | Daigle | 482/15 |
| 5,259,077 | A | * | 11/1993 | Hager et al. | 4/498 |
| 6,139,382 | A | * | 10/2000 | Eschbacher et al. | 441/32 |
| 6,442,773 | B1 | * | 9/2002 | Kopyar et al. | 4/498 |
| 7,275,668 | B1 | * | 10/2007 | Carroll | 224/190 |
| 2005/0076428 | A1 | | 4/2005 | Cicale et al. | |

* cited by examiner

*Primary Examiner* — Lauren Crane
(74) *Attorney, Agent, or Firm* — Porzio Bromberg & Newman P.C.

(57) ABSTRACT

The present invention provides a pool cover support system for installing a pool cover without touching the water in the pool. In one embodiment of the present invention, the system includes a flotation device including a frame extending upwardly from a base of the flotation device. The perimeter of the frame can be attached with a plurality of attachment cords to the outside ledge of the pool. Clips at one end of the attachment cords can be used for expeditiously attaching the frame to the ledge of the pool. The attachment cords and the frame can be used to support a light weight pool cover.

11 Claims, 14 Drawing Sheets

10
12
13
14
16
17
18
19
20
22
24
30
31
32
33
35
39
40
41
42
43
44
45

POOL COVER SUPPORT SYSTEM

CROSS REFERENCE TO RELATED APPLICATION

This application claims the benefit of U.S. Provisional Patent Application No. 61/388,178, filed Sep. 30, 2010, the entirety of which is hereby incorporated by reference into this application.

BACKGROUND OF THE INVENTION

During the winter months, pool covers are used to cover above-ground pools. Conventionally, one or more air pillows formed of a rubber material filled with air have been used to hold up the pool cover. The air pillows have the disadvantage of deflating.

U.S. Patent Application Publication No. 2005/0076428 describes a device for supporting a pool cover including a plurality of tubs coupled to one another. The tubs float on the surface of the water of the pool. The tubs can be attached to one another and attached to the outside of the pool. The tubs have the disadvantage of not holding the pool cover at a height that will enable rain or other debris to run off. It is desirable to provide an improved pool cover support system.

SUMMARY OF THE INVENTION

The present invention provides a pool cover support system for installing a pool cover without touching the water in the pool. The present invention eliminates the possibility of water and debris from collecting around the inside diameter of the pool cover and eliminates standing water which can become a breeding ground for mosquitoes. The system can be expeditiously installed for reducing the time and effort required to install and remove the pool cover. In addition, the present invention increases the life of the pool cover.

In one embodiment of the present invention, the system includes a flotation device including a frame extending upwardly from a base of the flotation device. The perimeter of the frame can be attached with a plurality of attachment cords to the outside ledge of the pool. Clips at one end of the attachment cords can be used for expeditiously attaching the frame to the ledge of the pool. The attachment cords and the frame can be used to support a light weight pool cover.

The attachment cords of the present invention can add additional inward pressure to support the pool walls when freezing occurs and it will not force outward pressure to the walls of the pool when installed. All pool configurations can be accommodated without the use of hardware. For example, in an oval-shaped pool, the flotation devices can be used with a center support that can snap in place between to span the straight sides of the oval-shaped pool. The center support that is used to support the attachment cords can include a spring loaded device, which can keep upward pressure on the center hub in the event that water should evaporate in the pool causing the flotation device to lower inside the pool. This will keep adequate pressure on the attachment cords to support the pool cover.

The invention will be more fully described by reference to the following drawings.

BRIEF DESCRIPTION OF THE DRAWINGS

FIG. 2 B is a front elevational view of the pool cover support system.

DETAILED DESCRIPTION

Figures 1, 2A, 2B, 2C, 3, 4:
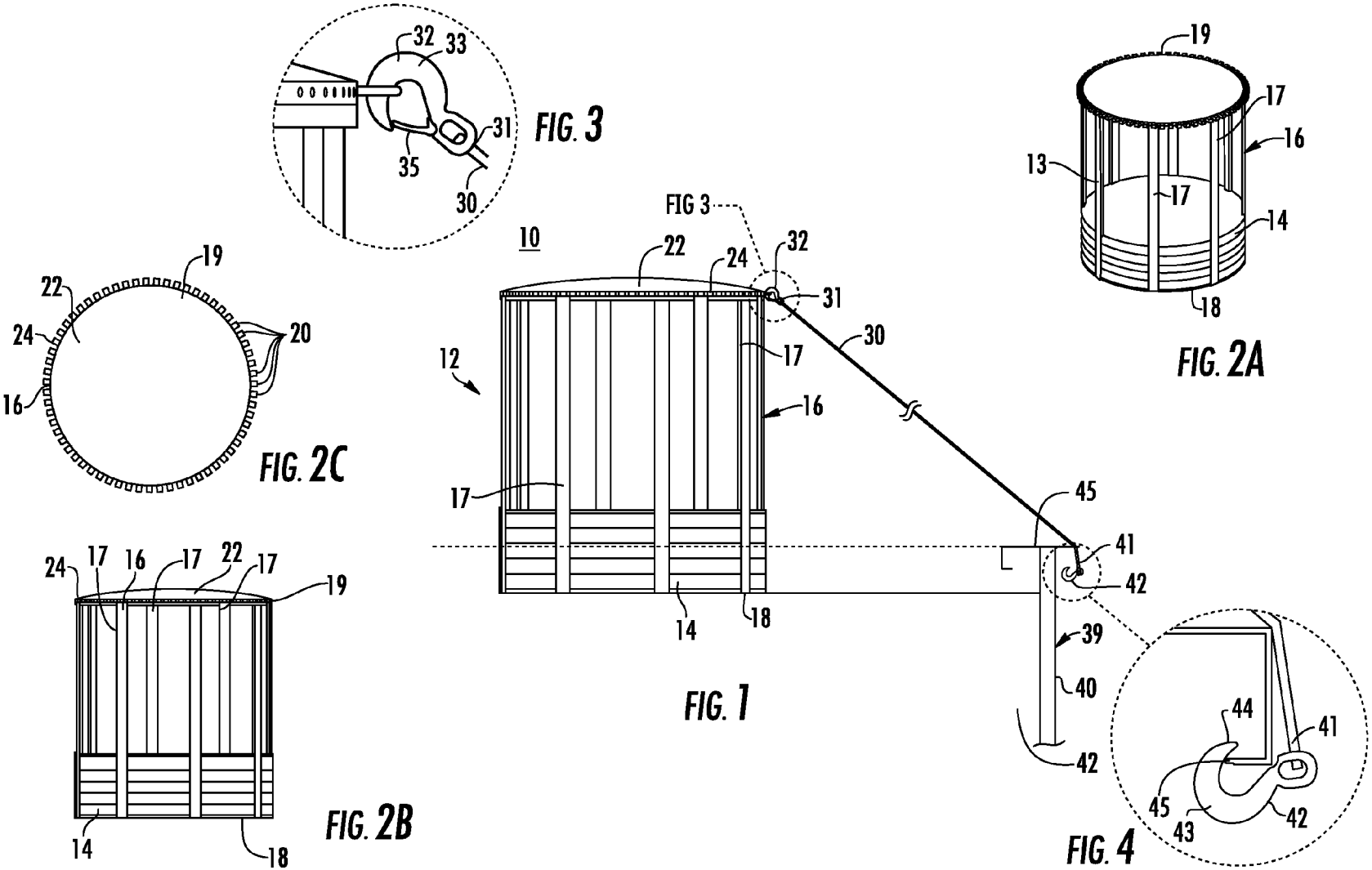
FIG. 1 is a side elevational view a pool cover support system attached to a pool, in accordance with the teachings of the present invention.
FIG. 2A is a perspective view of the pool cover support system.
FIG. 2C is a top plan view of the pool cover support system.
FIG. 3 is a schematic diagram of an attachment coupling member attached to a frame used in the pool cover support system.
FIG. 4 is a schematic diagram of an attachment coupling member attached to a pool.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of pool cover support system 10 in accordance with the teachings of the present invention. Flotation device 12 includes base 14 and frame 16 attached thereto, as shown in FIGS. 2A-2C. In one embodiment, flotation device 12 has a disc shape. Suitable materials for flotation device 12 are floatable materials, including foam or Styrofoam. The diameter of flotation device 12 is selected based on the size of the pool and can be in the range of about two feet to about four feet. The thickness of flotation device 12 is selected to provide adequate support and flotation of frame 16. For example, flotation device 12 can be about a four foot diameter by eight inch thick Styrofoam disc.

Frame 16 extends upwardly from base 14. Frame 16 can include a plurality of support ribs 17 extending from bottom frame 18 and top frame 19. Top frame 19 can include a plurality of attachment members 20. Attachment members 20 can be, for example, a C-hook or eyebolt. Suitable materials for frame 16, are light weight durable materials, including aluminum and plastic. Frame 16 can have a height to support a received pool cover over the height of the walls of the pool. For example, frame 16 can have a height in the range of about three feet to about five feet. Support pad 22 can be coupled to top surface 24 of frame 16.

Referring to FIG. 1, attachment cord 30 attaches frame 16 to wall 40 of pool 39. Attachment cord 30 can be formed of an elastic material. For example, attachment cord 30 can be formed of a fabric covered latex rubber cord, such as a bungee cord. Attachment coupling member 32 is coupled to end 31 of attachment cord 30. Attachment coupling member 32 attaches attachment cord 30 to frame 16. Attachment coupling member 32 can be a sling hook 33 including a latch 35, as shown in FIG. 3. Attachment coupling member 42 is coupled to end 41 of attachment cord 30. Attachment coupling member 42 attaches attachment cord 30 to wall 40. Attachment coupling member 42 can be a hook 43 without a latch, as shown in FIG. 4. End 44 of hook 43 can hook around ledge 45 extending from wall 40.

Figure 5:
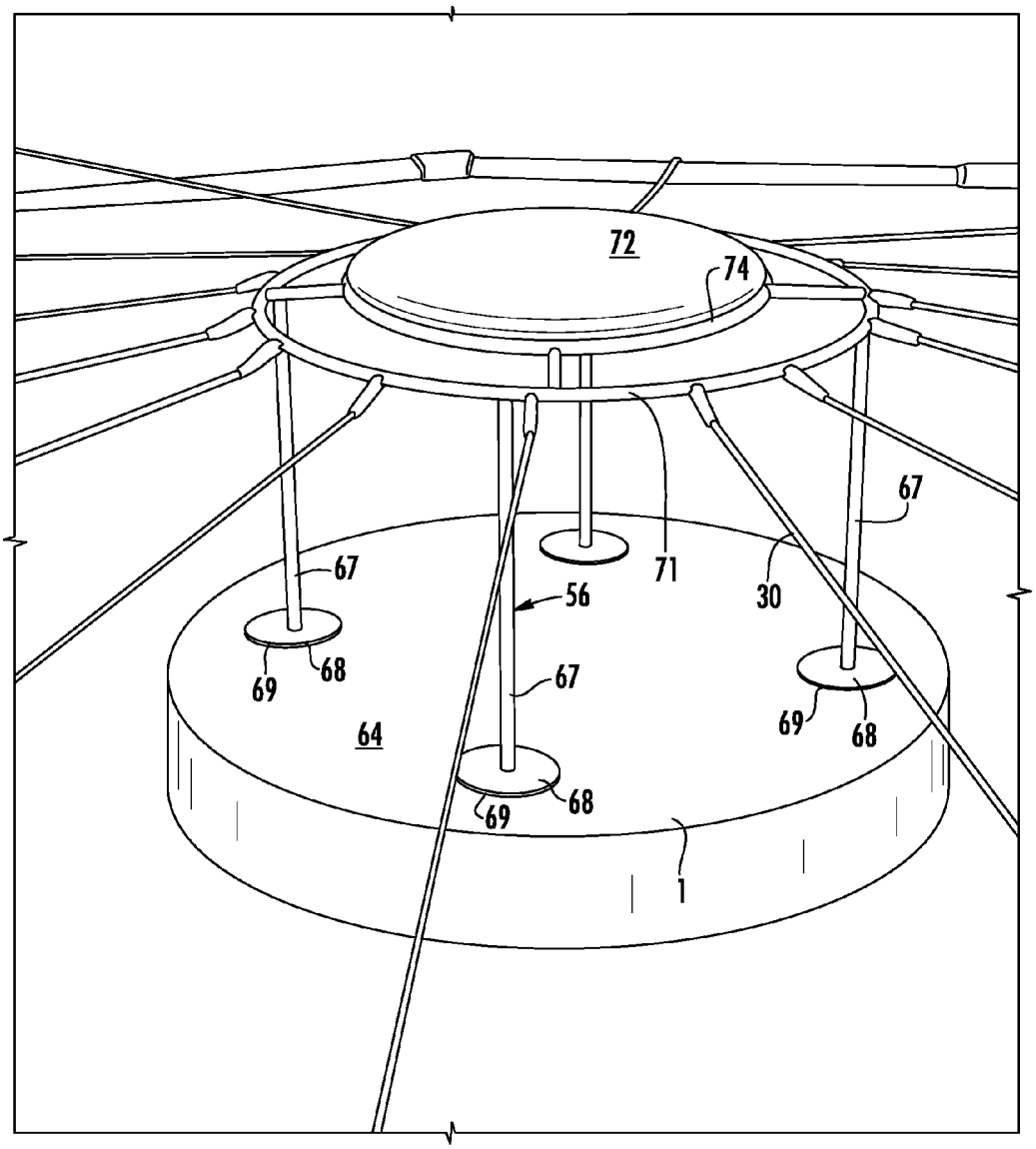
FIG. 5 is a perspective view of the pool cover support system upon attachment to a pool.
Figure 6:
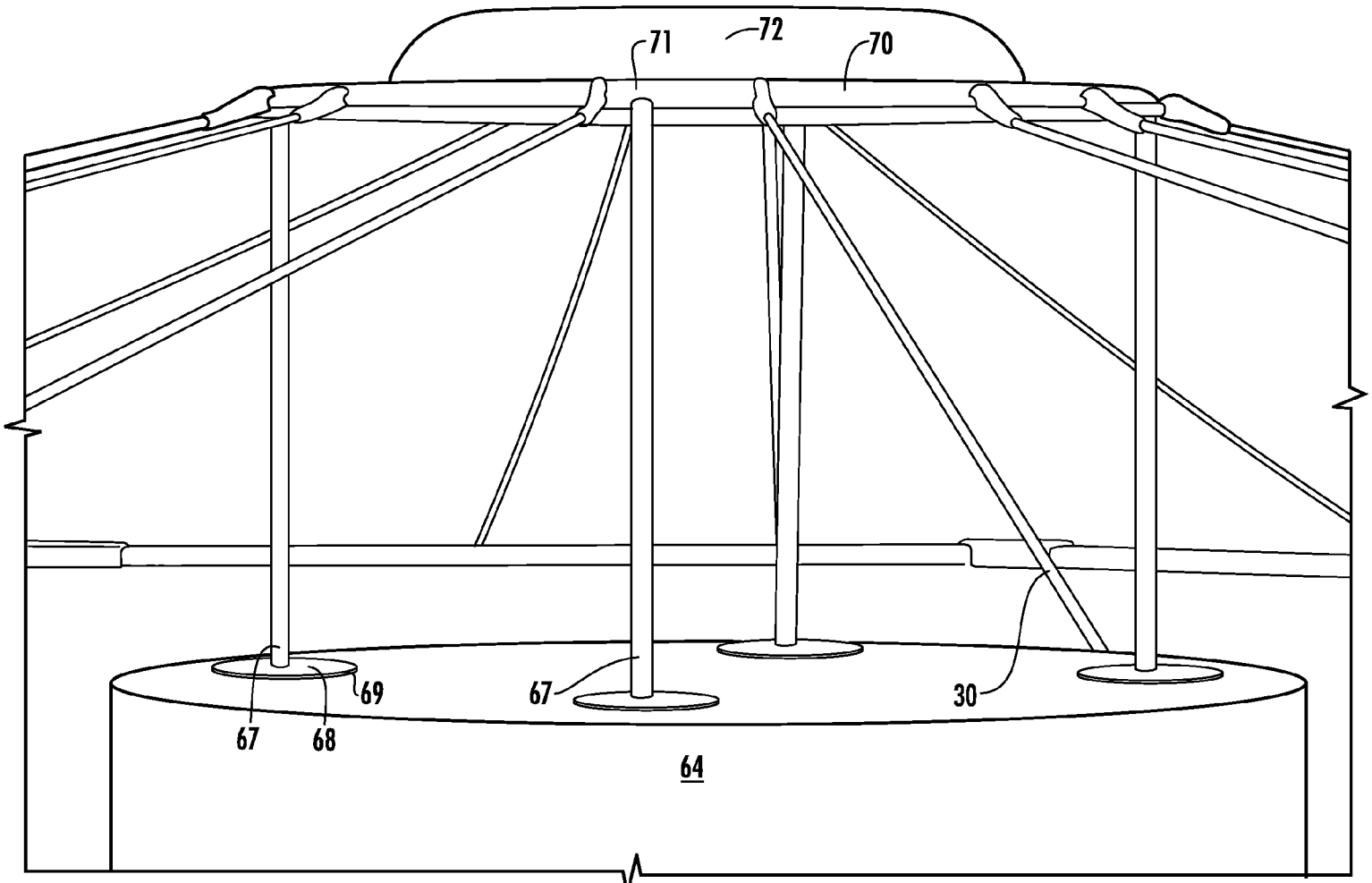
FIG. 6 is a side perspective view of the pool cover support system upon attachment to a pool.

FIG. 5 and FIG. 6 illustrate an alternative embodiment of pool cover support system 60. Frame 66 extends upwardly from base 64. Frame 66 includes a plurality of support ribs 67 extending from base supports 68. Base supports 68 can be removably attached to base 64. Upon removal of base supports 68, apertures 69 in base 64 can used to receive a drink cup or can. Upon removal of frame 16, an umbrella can be attached to base 64. Support ribs 67 are coupled or integral with top frame 71. Top frame 69 can include a plurality of attachment members 70. Attachment members 70 can be, for example, a C-hook or eyebolt. Suitable materials for frame 66 are light weight durable materials including aluminum and plastic. Frame 66 can have a height to support a received pool cover over the height of the walls of the pool. For example, frame 66 can have a height in the range of about three feet to about five feet. Support pad 72 can be coupled to top surface 74 of frame 66. Support pad 72 can be formed of a cushion or plastic material for contacting an attached pool cover.

Figure 7:
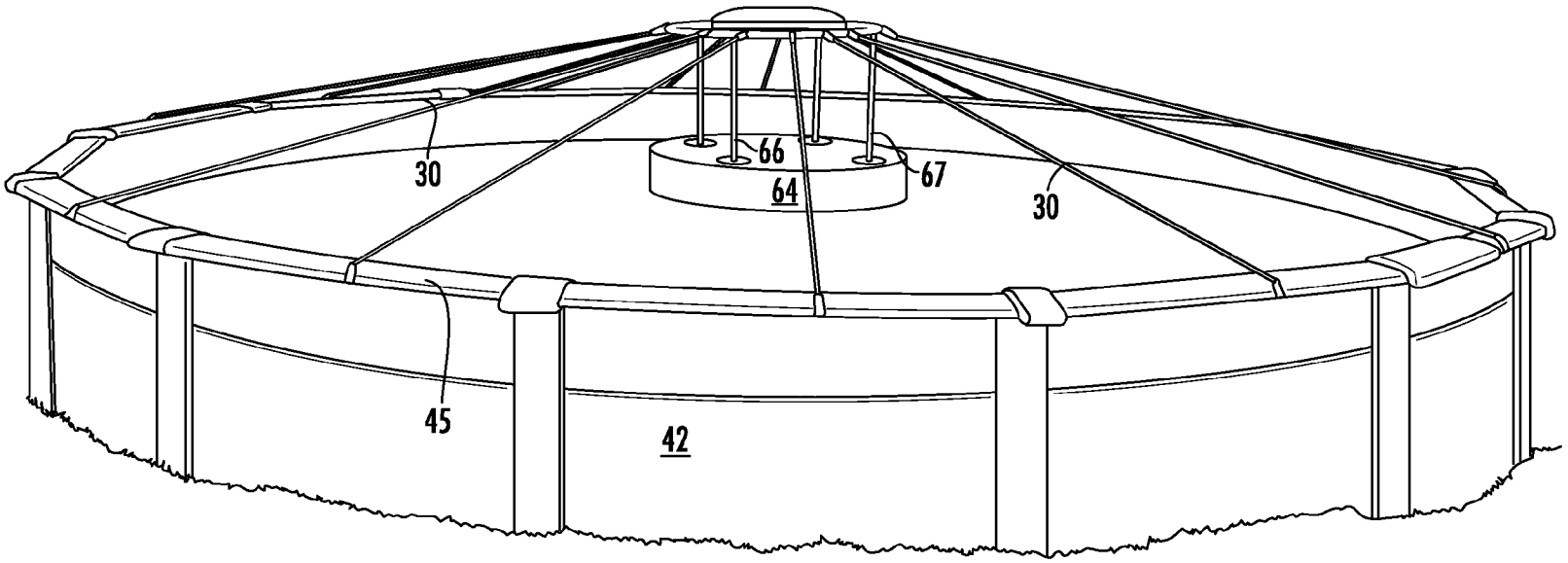
FIG. 7 is a perspective view of the pool cover support system upon attachment to a pool.

FIG. 7 illustrates attachment of pool cover support system 60 to pool 39. A plurality of attachment cords 30 are attached between frame 66 and ledge 45 of pool 39. For example, attachment cords 30 can be spaced approximately six inches to about 36 inches apart around the perimeter of pool 39.

Figure 8:
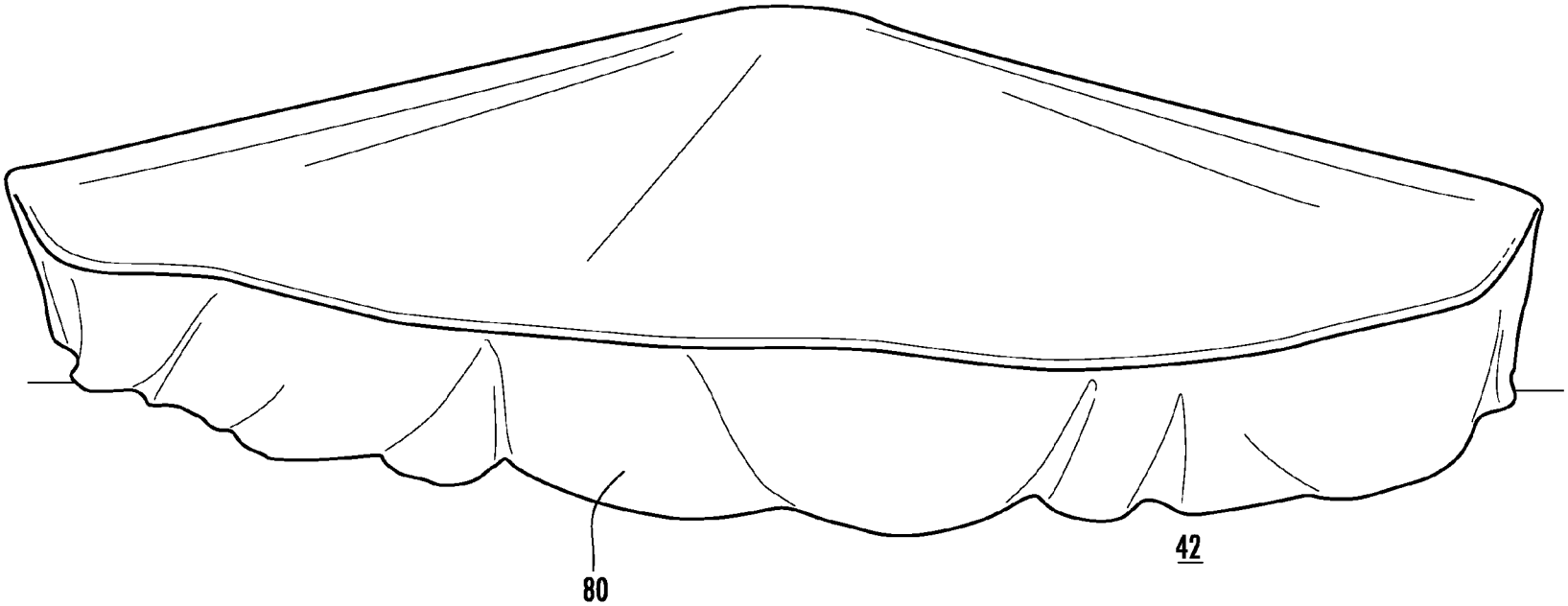
FIG. 8 is a perspective view of the pool cover support system upon attachment to a pool and receipt of a pool cover over the pool cover support system.

FIG. 8 illustrates attachment of pool cover 80 over pool cover support system 60. The tension on attachment cords 30 is used to support pool cover 80. Pool cover support systems 10 and 60 can be designed to fit on any size above ground pool, which includes, and is not limited to oval-shaped pools. The length of attachment cords 30 can be selected to provide desired tension at a predetermined size of the pool.

Figure 9:
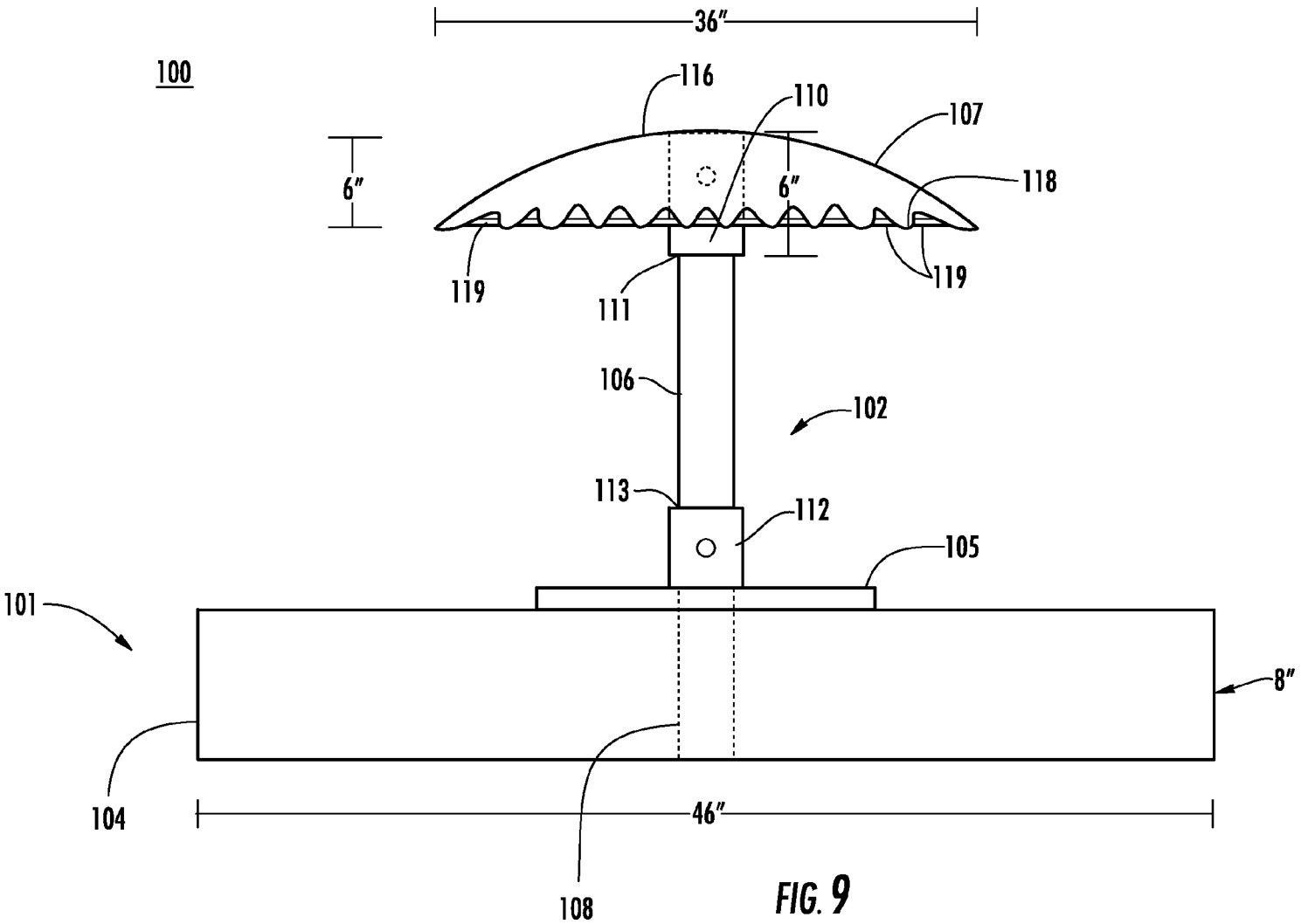
FIG. 9 is a schematic diagram of an alternate embodiment of the pool cover support system.
Figure 10:
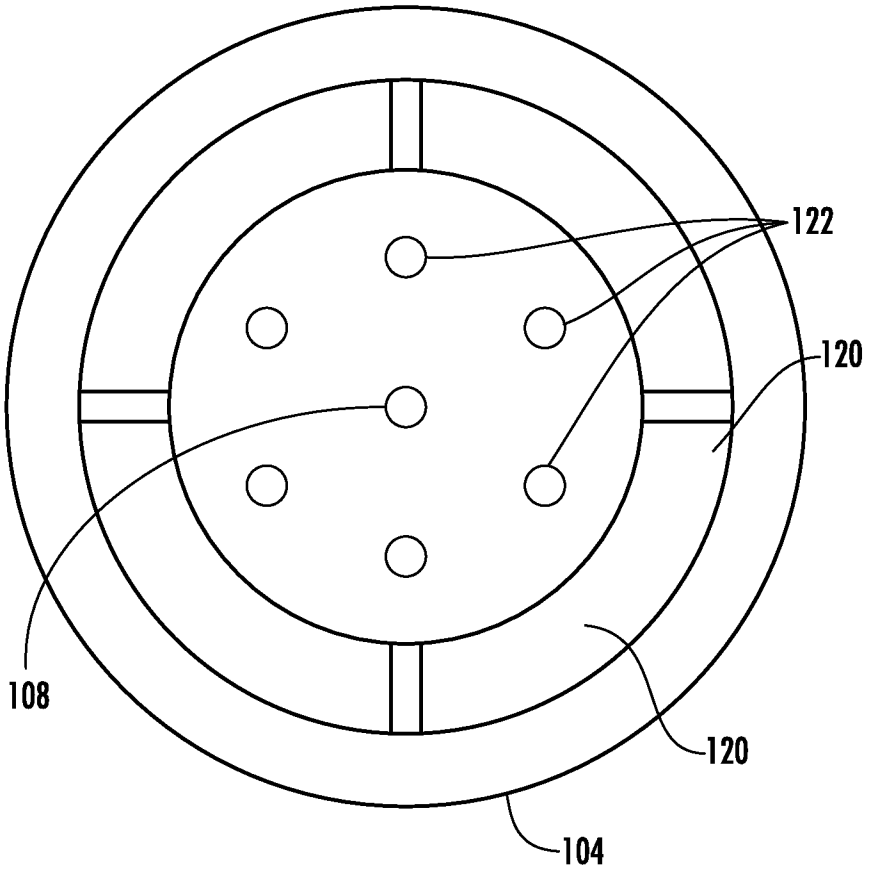
FIG. 10 is a top plan view of the pool cover support system shown in FIG. 9.
Figure 11:
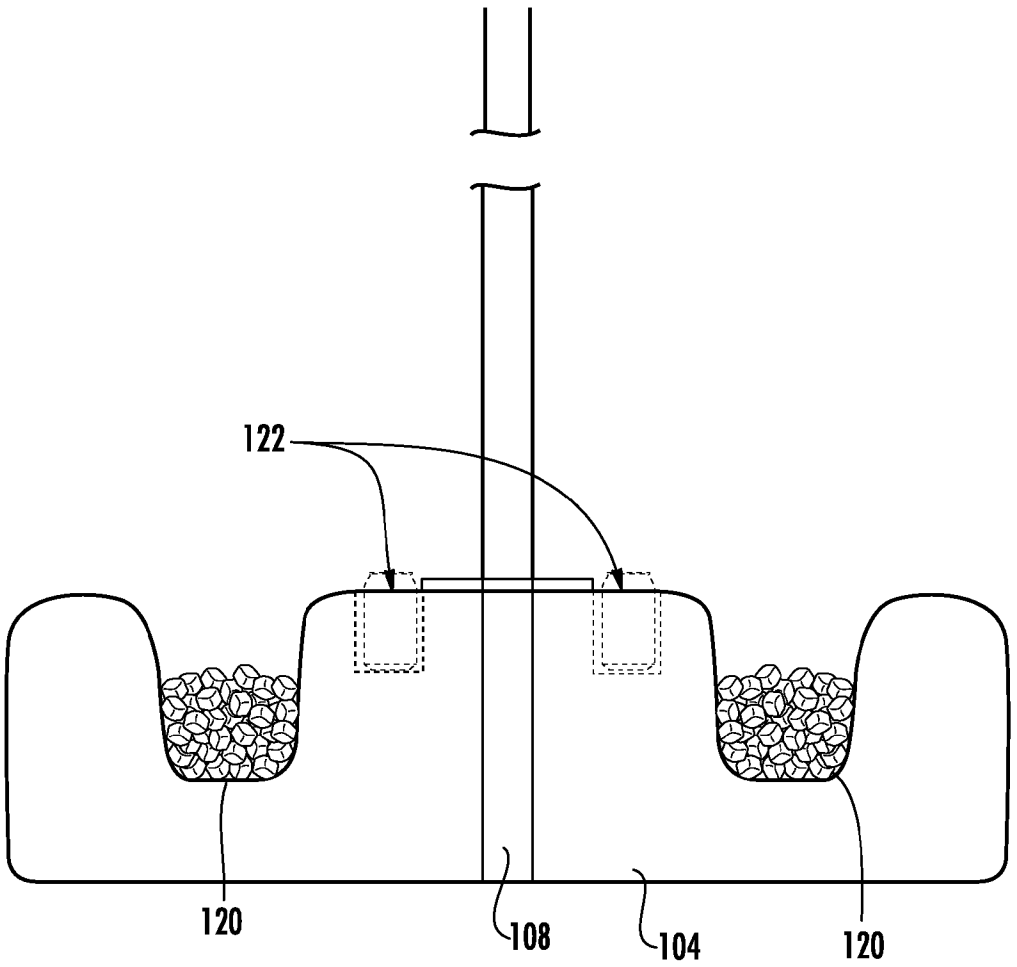
FIG. 11 is a side cross-sectional view of the pool cover support system shown in FIG. 9.

FIGS. 9-11 illustrate an alternative embodiment of pool cover support system 100. Flotation device 101 includes frame 102 and base 104 attached thereto. Frame 102 extends upwardly from base 104. Base 104 can be formed of a floatable material. A suitable material for base 104 is foam or Styrofoam. Frame 102 includes bottom plate 105 and upper support 107 removably attached to support pole 106. Upper support 107 can have a diameter to support a pool cover. For example, upper support 107 can have a diameter of thirty-six inches. Base 104 can have a thickness to provide support of a received support pole 106 and upper support 107. For example, base 104 can have a thickness of six to ten inches, preferably eight inches. Support pole 106 can be received in support pole aperture 108 in base 104 to extend to base 104.

Bottom plate 105 can be attached to base 104. In one embodiment bottom plate 105 is circular and has a diameter of eighteen inches, as shown in FIG. 10.

Referring to FIG. 9, support pole 106 can include coupling member 110 at top end 111 and coupling member 112 at bottom end 113. Coupling member 110 can be used to couple support pole 106 to upper support 107. Coupling member 112 can be used to couple support pole 106 to bottom plate 105. In one embodiment, coupling members 110 and 112 are spring loaded clip locks.

Figure 12:
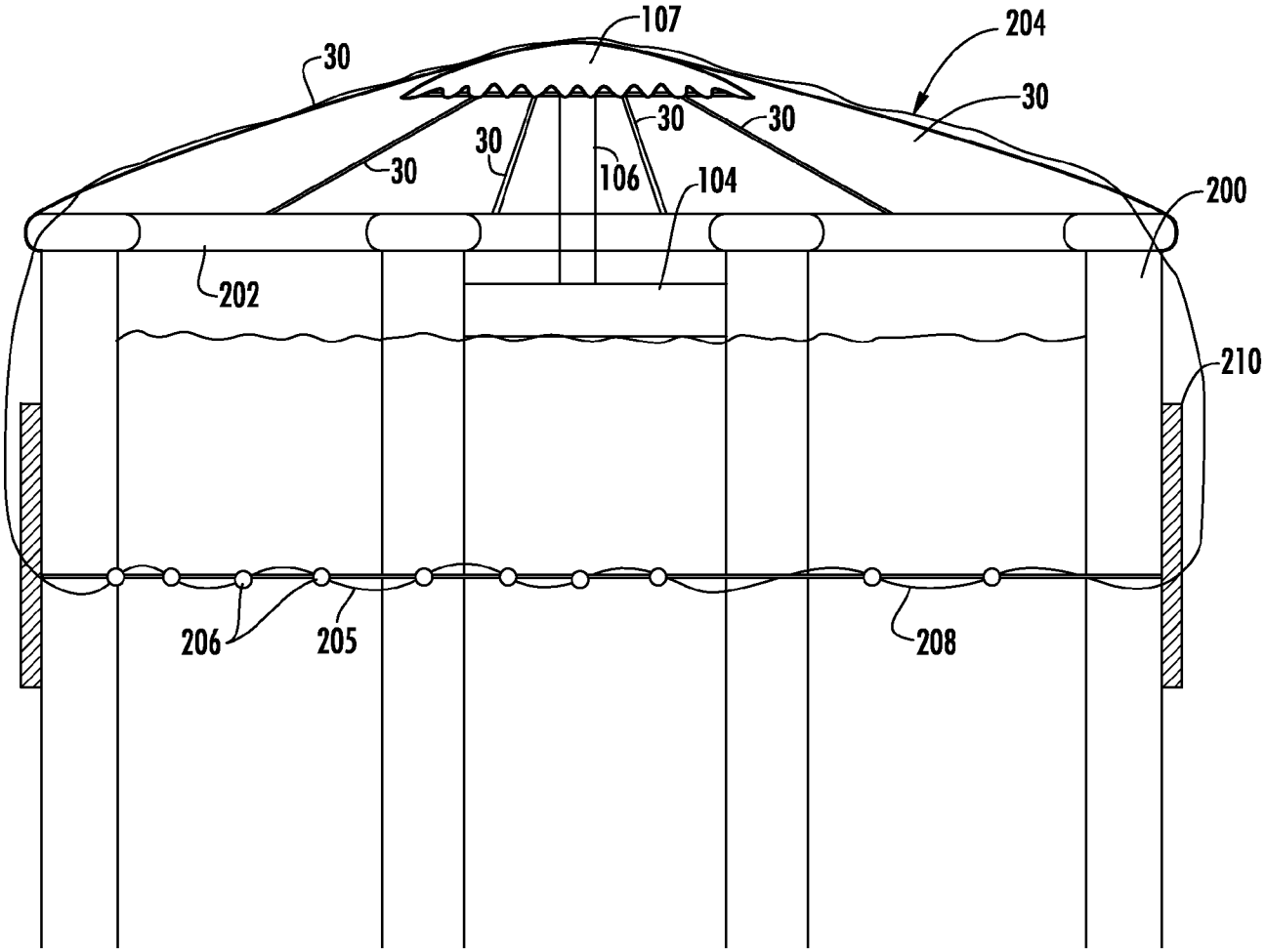
FIG. 12 is a perspective view of the pool cover support system shown in FIG. 9 upon attachment to a pool and receipt of a pool cover over the pool cover support system.

Top 116 of upper support 107 can be rounded. Top 116 can be formed of a cushion or plastic material for contacting an attached pool cover. Upper support frame 118 can extend around upper support 107. Upper support frame 118 can be used to attach attachment cords 30, as shown in FIG. 12. Upper support frame 118 can include a plurality of attachment members 122. Attachment members 119 can be, for example, a C-hook or eyebolt. Suitable materials for upper support frame 118 are light weight durable materials including, metal, aluminum and plastic.

Upper support frame 118 attached to support pole 106 can have a height to support a received pool cover over the height of the walls of the pool. For example, upper support frame 118 attached to support pole 106 frame can have a height in the range of about three feet to about five feet.

Referring to FIGS. 10 and 11, groove 120 within base 104 can be used to receive ice to keep beverages cool when base 104 has support pole 106 and upper support 107 removed. Apertures 122 in base 104 can used to receive a beverage cup or receptacle. For example, beverage receptacle can be a beverage can or beverage bottle.

FIG. 12 is a schematic diagram of a method of attaching pool cover support system to pool 200. Support pole 106 is attached to base 104 and upper support 107. Base 104 is put on top of water within pool 200. Attachment cords 30 are attached to sides 202 of pool 200. Pool cover 204 is placed over upper support 107 and attachment cords 30. Upper support 107 and attachment cords 30 support pool cover 204. Bottom edge 205 of pool cover 204 can include a plurality of cover apertures 206. Cable 208 can threaded through cover apertures 206 and tightened around pool 200 to support pool cover 204. Attachment support strip 210 can extend over cable 208. Attachment support strip 210 can attach pool legs 215 with fastener 216. Attachment support strip 210 can be formed of plastic.

Figure 13A:
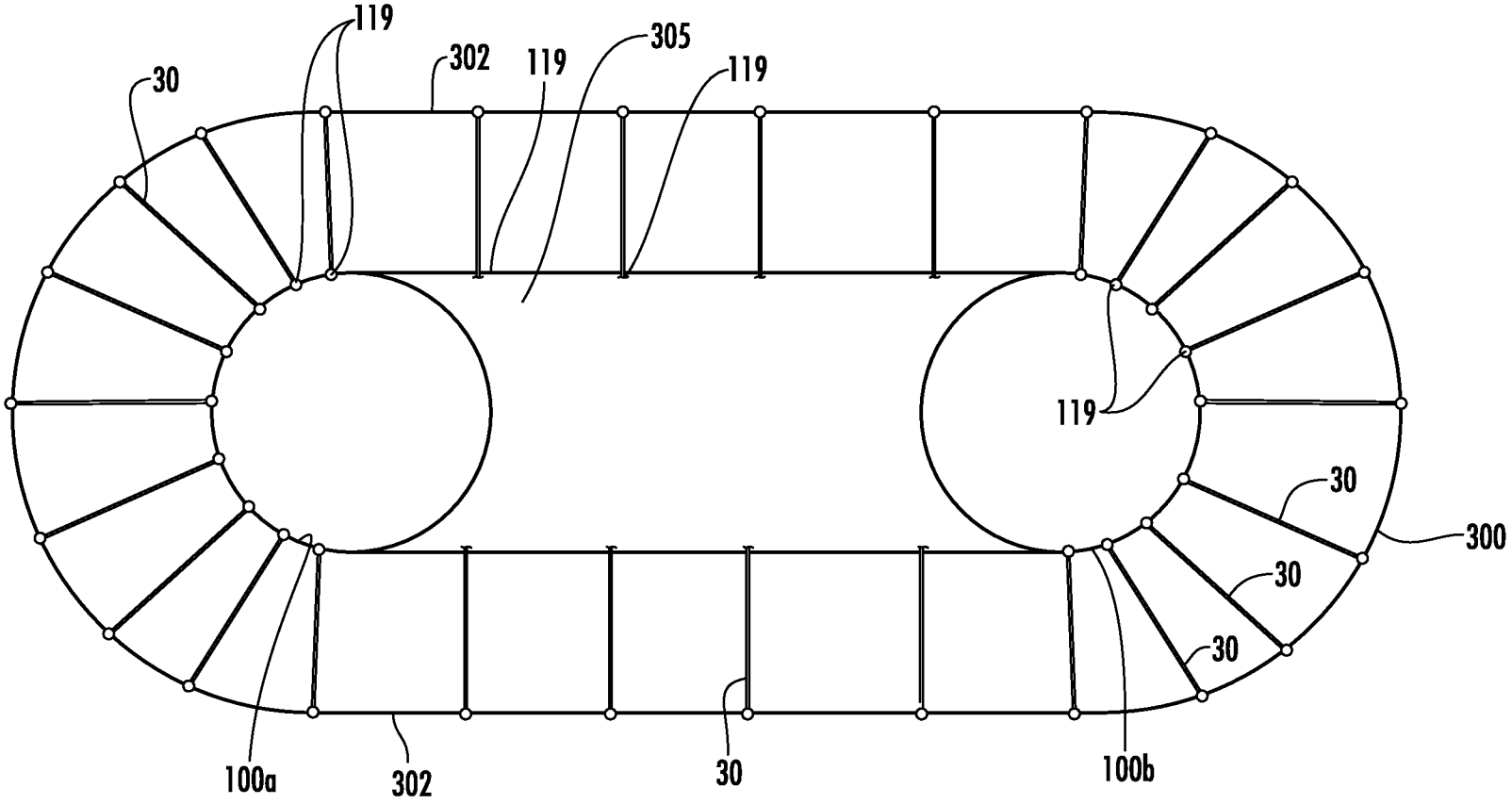
FIG. 13A is a perspective view of the use of two pool cover support systems shown in FIG. 9 and a center section upon attachment to a pool.
Figure 13B:
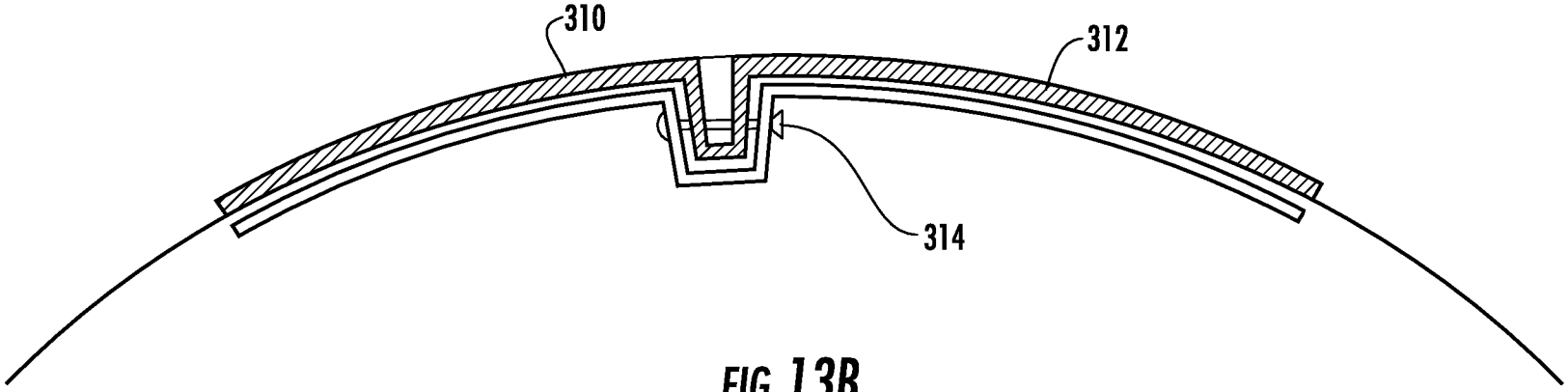
FIG. 13B is an end view of the adjustable center support section.
Figure 13C:
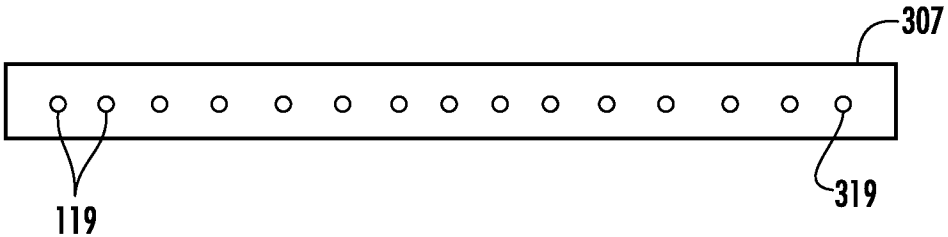
FIG. 13C is a side view of the adjustable center support section.
Figure 14:
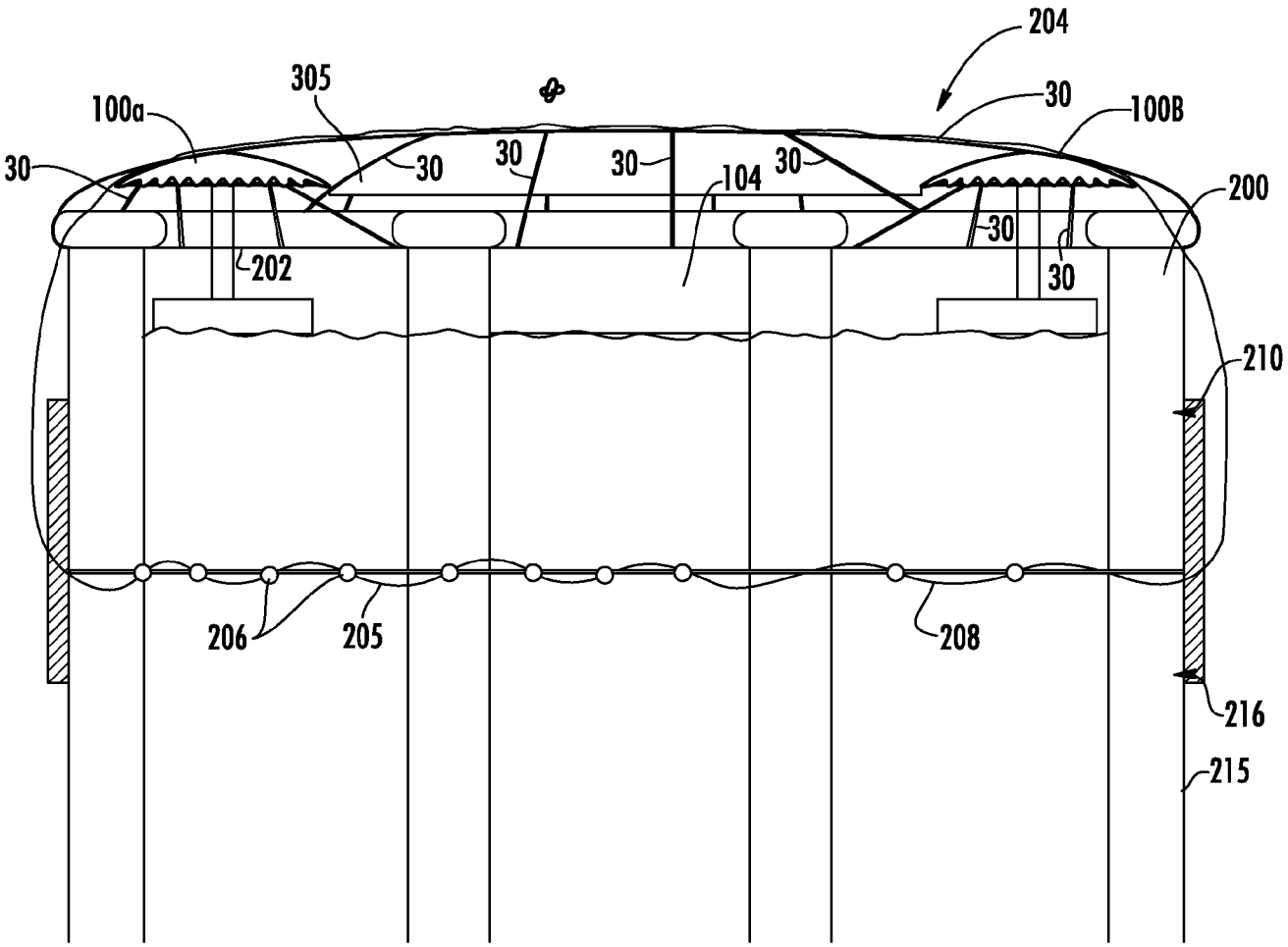
FIG. 14 is a perspective view of the use of two pool cover support systems shown in FIG. 9 and an adjustable center support section upon attachment to a pool and receipt of a pool cover over the pool cover support system.

FIGS. 13A-13C is a schematic diagram of a method of attaching pool cover support system to pool 300. Pool cover support system 100*a*, 100*b* are placed in pool 300. Pool 300 can have an oval shape. Adjustable center section support 305 can be positioned or snap fit in between pool cover support system 100*a* and pool cover support system 100*b*. Adjustable center section support 305 can be formed of a cushion or plastic material. Adjustable center section support 305 can include frame 307 including attachment members 119. Adjustable center section support 305 can be formed of upper support portion 310 and upper support section 312. Upper support section 310 and upper support section 312 can be attached at a desired location with fastener 314. Upper support section 310 and upper support section 312 can slide over one another. Attachment cords 30 attach cover support system 100*a*, 100*b* and adjustable center section 305 to sides 302 of pool 300. Pool cover 304 is placed over pool cover support system 100*a* and attachment cords 30, as shown in FIG. 14. Pool cover support system 100*a*, 100*b* and attachment cords 30 support pool cover 304.

Figure 15:
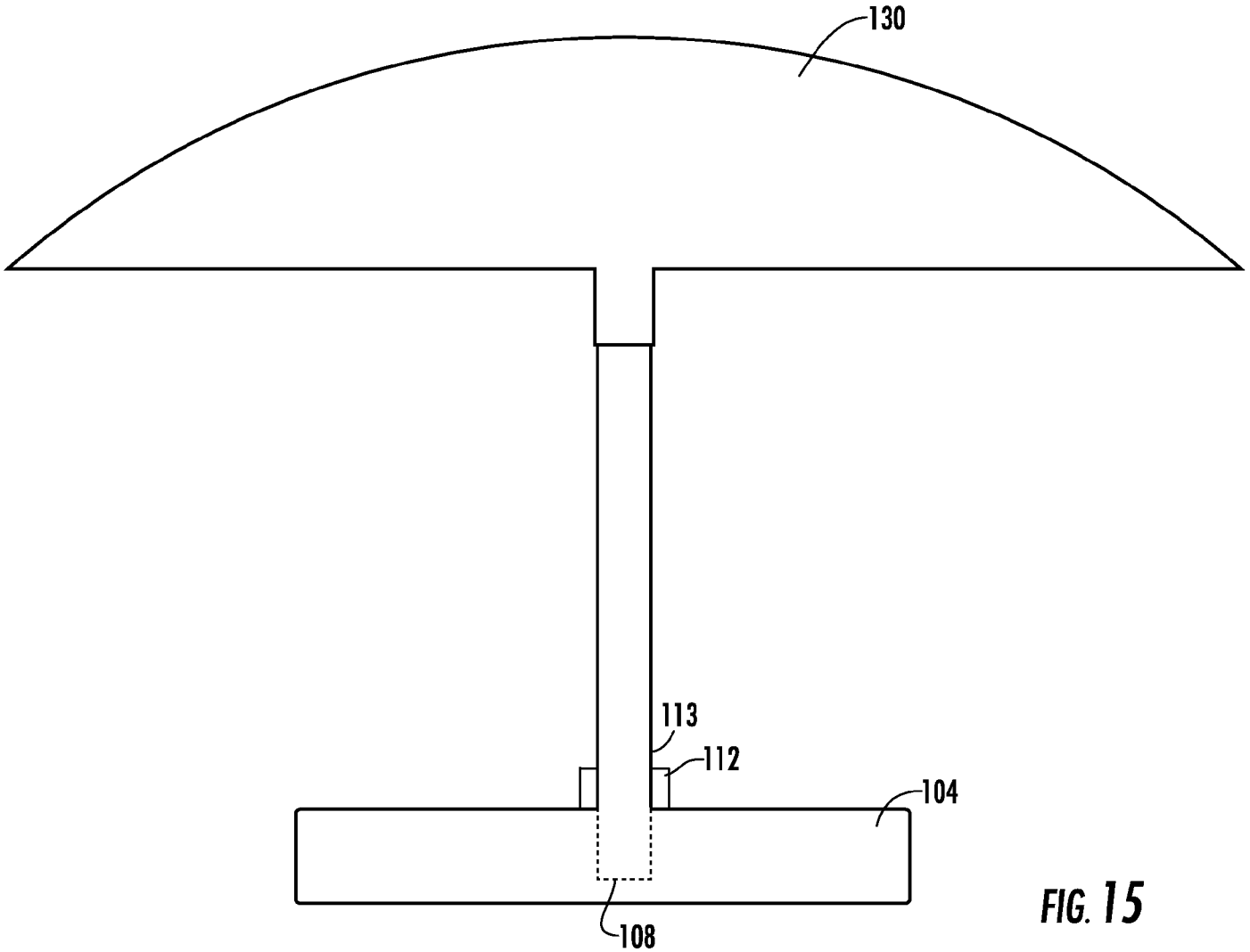
FIG. 15 is a schematic diagram of the pool cover support system in combination with an umbrella.

Upon removal of frame support pole 107, umbrella 130 can be attached to base 104 and received in support pole aperture 108 in base 104 using coupling member 112, as shown in FIG. 15.

Figure 16:
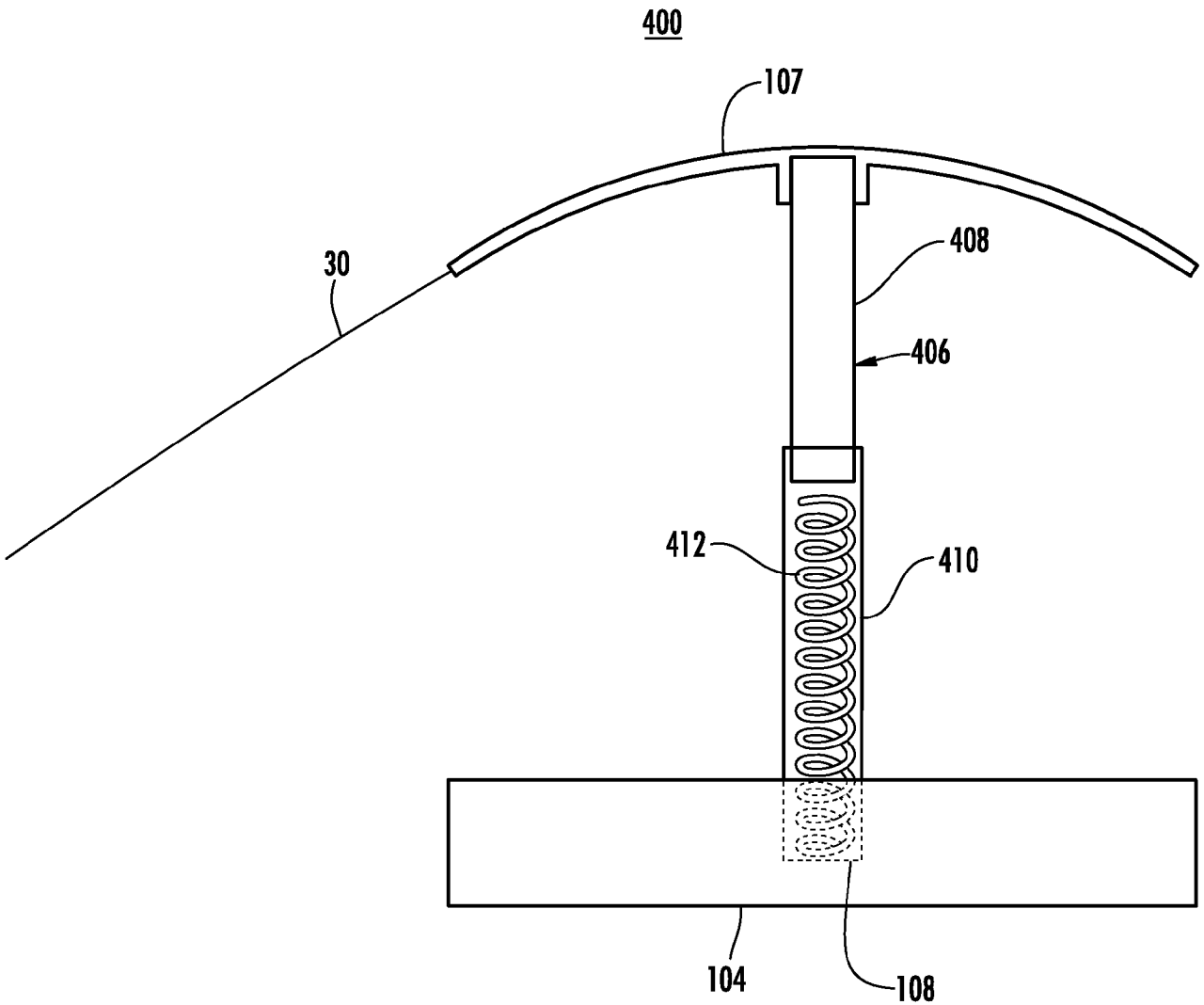
FIG. 16 is a schematic diagram of an alternate embodiment of the pool cover support system.

FIG. 16 illustrate an alternative embodiment of pool cover support system 400. Support rod 406 is formed of first support rod 408 received in second support rod 410. Bias member 412 is positioned between first support rod 408 and second support rod 410. For examples, bias member 412 an be a spring. Pool cover support system 400 can be used to absorb the weight of snow received on an attached pool cover.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A pool cover support system comprising;

a single floatable base having a disc shape, a frame extending upwardly from said base, said frame comprises a support rod removably attached to a base plate and a center section of an upper support frame, a top of said upper support frame is rounded in a dome shape and has a diameter adapted to support a pool cover, said base plate being attached to the top surface of said floatable base, said base plate resting on said floatable base, said base plate being circular and radially extending over said base, a plurality of attachment cords removably attached to said upper support frame and adapted to be attached to a wall of a pool, said attachment cords are fabric coated rubber cord, said upper support frame includes a plurality of attachment members around the perimeter of said upper support, said plurality of attachment cords being removably attached to said plurality of attachment members, said support rod is formed of a first support rod received in a second support rod, said second support rod is coupled to said base plate with a coupling member, said coupling member is a spring loaded clip lock, said second support rod extends within said base, and a bias member is positioned between said first support rod and said second support rod, wherein said bias member can absorb weight of the pool cover received over said upper support frame.

2. The pool support cover system of claim 1 wherein said upper support frame attached to said support pole has a height to support a received pool cover over the height of the walls of the pool.

3. The pool support cover system of claim 2 wherein the height is in the range of about three feet to about five feet.

4. The pool support cover system of claim 1 wherein said floatable base is formed of Styrofoam.

5. The pool support cover system of claim 1 wherein said pool cover includes a plurality of cover apertures at a bottom edge and a cable is adapted to be received in said cover apertures, wherein said cable is tightened around said pool for supporting said pool cover.

6. The pool support cover system of claim 1 further comprising an attachment support strip extending over said cable.

7. The pool support cover system of claim 1 further comprising a plurality of beverage apertures in said base, wherein said beverage apertures have a size for receiving a beverage receptacle or beverage cup.

8. The pool support cover system of claim 1 further comprising an umbrella wherein said support rod is adapted to be removed from support aperture in said base and said umbrella is inserted in said support aperture.

9. The pool support cover system of claim 1 further comprising an attachment coupling member attached to each end of said attachment cord.

10. The pool support cover system of claim 9 wherein said attachment coupling member is a sling hook including a latch.

11. The pool support cover system of claim 1 wherein said attachment members are a C-hook or eyebolt.

* * * * *